US007017990B2

(12) United States Patent
Mendenhall et al.

(10) Patent No.: US 7,017,990 B2
(45) Date of Patent: Mar. 28, 2006

(54) STACKABLE CHAIR WITH CHAIR GANGER APPARATUS

(75) Inventors: Andrew B. Mendenhall, Indianapolis, IN (US); Jason S. Andrews, Indianapolis, IN (US); Dennis M. Turner, Mooresville, IN (US)

(73) Assignee: Cosco Management, Inc., Wilmington, DE (US)

( * ) Notice: Subject to any disclaimer, the term of this patent is extended or adjusted under 35 U.S.C. 154(b) by 77 days.

(21) Appl. No.: 10/621,503

(22) Filed: Jul. 17, 2003

(65) Prior Publication Data

US 2005/0012371 A1 Jan. 20, 2005

(51) Int. Cl.
*A47C 15/00* (2006.01)

(52) U.S. Cl. ..... 297/248

(58) Field of Classification Search ..... 297/248, 297/249, 239; 248/501, 500; 403/315
See application file for complete search history.

(56) References Cited

U.S. PATENT DOCUMENTS

| | | | | |
|---|---|---|---|---|
| 2,956,618 | A | 10/1960 | Eames et al. | |
| 3,018,131 | A * | 1/1962 | Krueger | 297/248 |
| 3,025,105 | A | 3/1962 | Nash | |
| 3,084,977 | A | 4/1963 | Chapman | |
| 3,133,762 | A | 5/1964 | Newman | |
| 3,144,271 | A | 8/1964 | Lieberman et al. | |
| 3,183,034 | A | 5/1965 | Midyette, Jr. | |
| 3,291,523 | A | 12/1966 | Krueger | |
| 3,328,075 | A | 6/1967 | Albinson | |
| 3,351,378 | A | 11/1967 | Bliss | |
| 3,365,233 | A | 1/1968 | Uyeda et al. | |
| 3,402,963 | A | 9/1968 | Fujioka et al. | |
| 3,610,686 | A | 10/1971 | Caruso | |
| 3,637,256 | A | 1/1972 | Harty | |
| 3,695,694 | A | 10/1972 | Mohr | |
| 3,697,130 | A | 10/1972 | Barecki et al. | |
| 3,758,155 | A | 9/1973 | Straits | |
| 3,826,453 | A | 7/1974 | Hitchcock | |
| 3,847,433 | A | 11/1974 | Acton et al. | |
| 4,386,804 | A | 6/1983 | Ware et al. | |
| 4,400,031 | A | 8/1983 | DeDecker | |
| 5,002,337 | A | 3/1991 | Engel et al. | |
| 5,154,474 | A | 10/1992 | Desanta | |
| 5,282,669 | A * | 2/1994 | Barile | 297/248 |
| 5,352,017 | A * | 10/1994 | Berning | 297/248 |
| 5,544,938 | A * | 8/1996 | Saul et al. | 297/248 |
| 5,863,096 | A | 1/1999 | Bartlmae | |
| 6,338,528 | B1 * | 1/2002 | Lohness et al. | 297/248 |

* cited by examiner

*Primary Examiner*—Milton Nelson, Jr.
(74) *Attorney, Agent, or Firm*—Barnes & Thornburg LLP

(57) ABSTRACT

A chair ganger apparatus includes a first cross bar included in a first chair, a second cross bar included in a second chair, and a gang flange coupled to the first and second cross bars to retain the first and second chairs in "ganged" relation to one another.

17 Claims, 3 Drawing Sheets

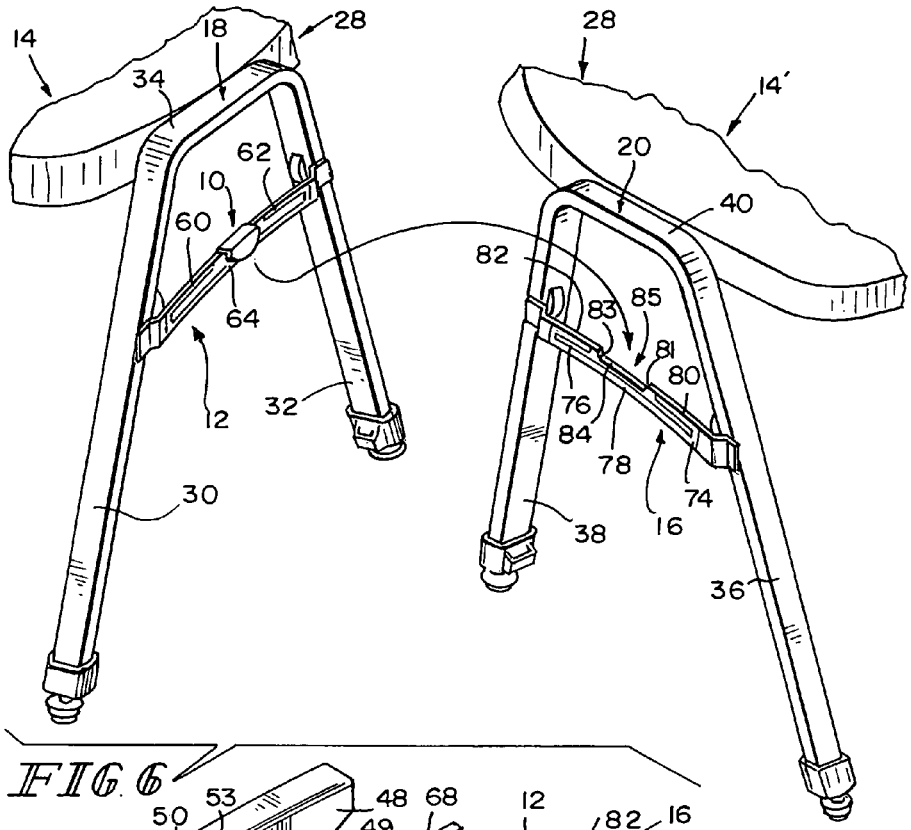
FIG. 6
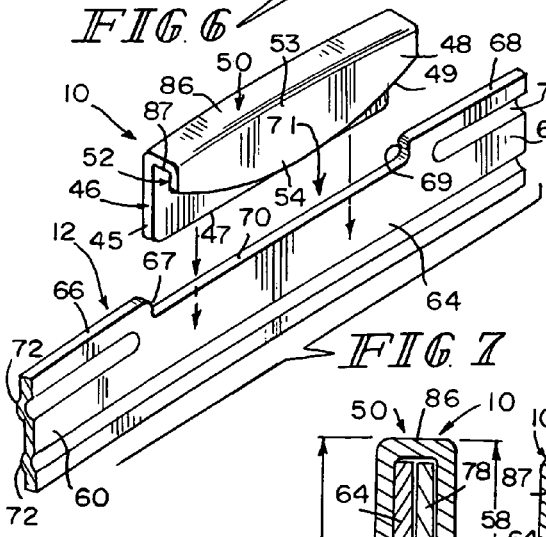
FIG. 7
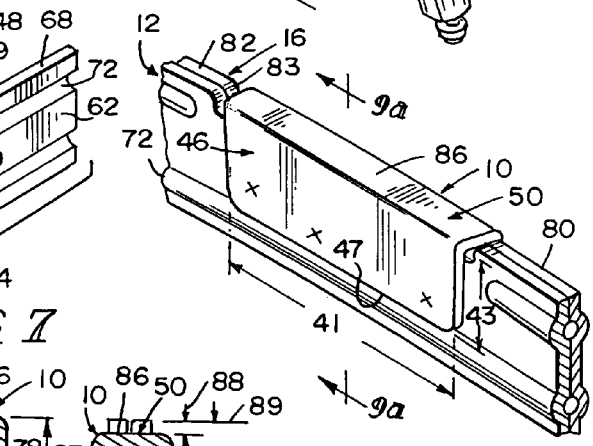
FIG. 8
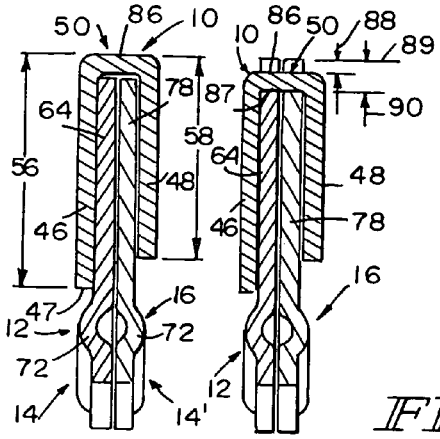
FIG. 9a
FIG. 9b

STACKABLE CHAIR WITH CHAIR GANGER APPARATUS

BACKGROUND AND SUMMARY

The present disclosure relates to chairs, and particularly to stackable and gangable chairs. More particularly, the present disclosure relates to apparatus for ganging chairs.

In commercial and educational settings, there is a need for chairs that are configured to be stacked on top of one another for storage purposes. In some situations, these chairs are unstacked and arranged in rows. Adjacent chairs are then "ganged" (i.e., connected) together to maintain a fixed straight alignment of the chairs arranged in a row.

According to the present disclosure, a chair ganger apparatus comprises a gang flange formed to include a cross bar retainer channel sized to receive a first cross member of one chair and a second cross member of an adjacent chair. The gang flange includes first and second side walls and a top wall cooperating with the first and second side walls to define the cross bar retainer channel therebetween.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 6 is an enlarged perspective view of portions of the chairs shown in FIG. 2 illustrating how the gang flange on the left chair can be moved to mate with the gang-flange receiver channel of the right chair;

FIG. 7 is an enlarged perspective view of a portion of the left chair of FIG. 6 showing the gang flange before it is mounted on the first cross bar of the left chair;

FIG. 8 is a perspective view of the components shown in FIG. 7 (from a different point of view) showing the gang flange mounted on the flange mount provided by the first cross bar of the left chair and the second cross bar of the right chair;

FIG. 9*a* is an enlarged sectional view taken along line 9—9 of FIG. 8 showing that first and second side walls of the gang flange cooperate to define a cross bar receiver channel sized to receive therein a "fixed " plate included in the first cross bar and a "removable " plate included in the second cross bar; and FIG. 9*b* is a sectional view similar to FIG. 9*a* showing another embodiment.

DETAILED DESCRIPTION

Figure 1:
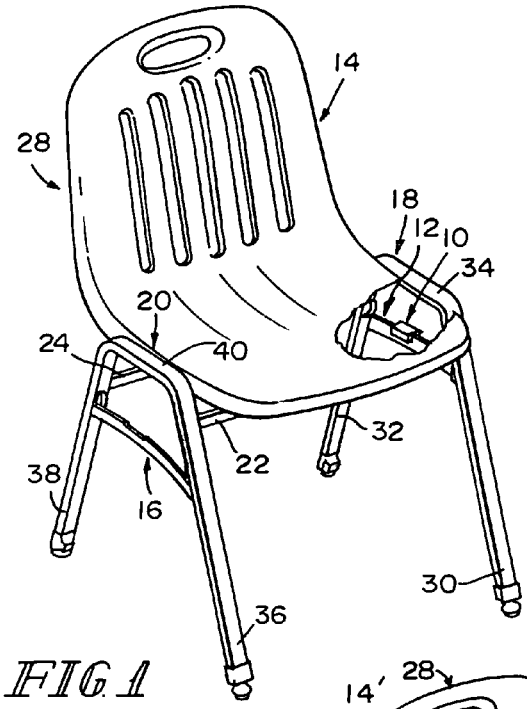
FIG. 1 is a perspective view of a first chair according to this disclosure, with a portion broken away, to show a gang flange mounted on a first cross bar located under the seat bottom and showing a gang-flange receiver channel formed in a second cross bar located under the seat bottom and in spaced-apart relation to the first cross bar.
Figure 3:
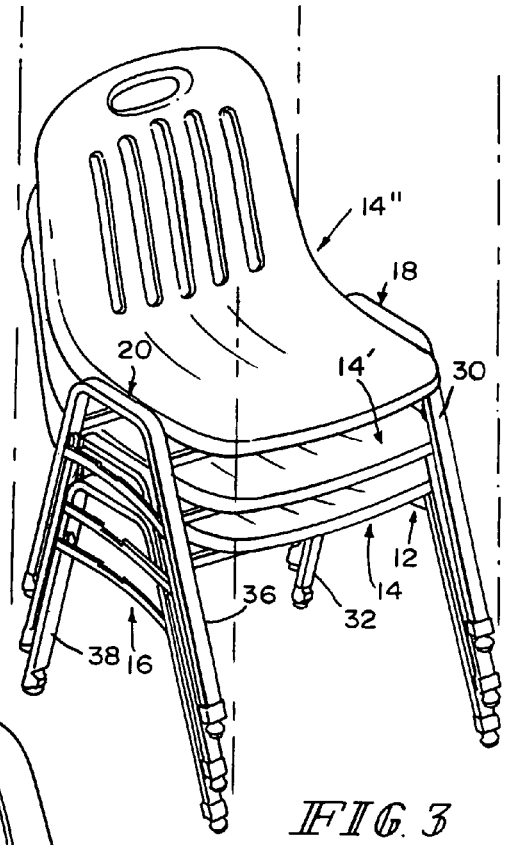
FIG. 3 is a perspective view similar to FIG. 1 showing three chairs of the type shown in FIG. 1 wherein the chairs are stacked vertically, "guide" bumpers are located on a lower portion of each leg, "stacker" bumpers are located on an upper portion of each leg, and the bumpers cooperate with the legs of an underlying chair to "separate" one chair from another when stacked as shown in a vertical stack to prevent marring or scratching of the chair legs.

A gang flange 10 is coupled to a first cross bar 12 included in a chair 14 as shown in FIG. 1. Chair 14 also includes a second cross bar 16 arranged to lie in spaced-apart relation to first cross bar 12. Gang flange 10 on chair 14 is arranged and configured to mate with a second cross bar 16 on an adjacent chair 14' to "gang" chairs 14 and 14' together as shown, for example, in FIG. 2. Using gang flange 10, chairs 14 and 14' can be ganged to one another (as suggested in FIGS. 2 and 6) or stacked on one another (as shown in FIG. 3) easily.

Figure 4:
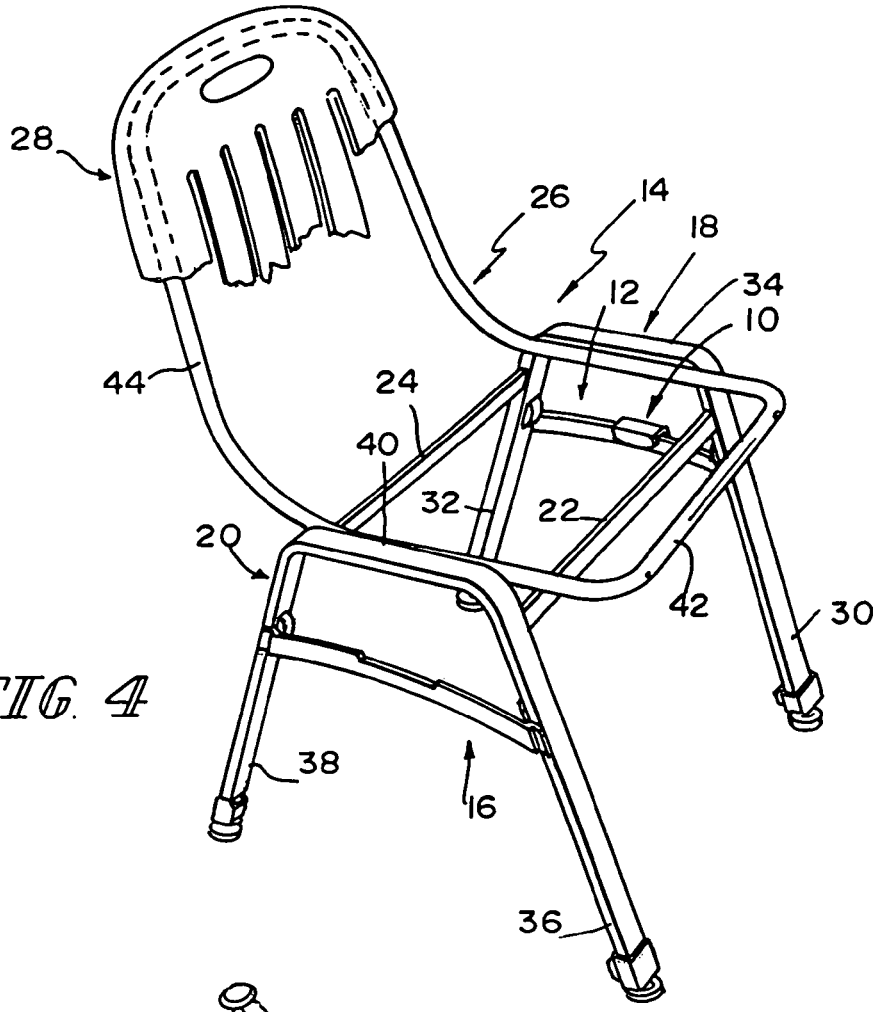
FIG. 4 is a perspective view of the chair of FIG. 1 with a portion of the seat shell removed to show first and second leg units, front and rear frame mounts extending between the first and second leg units, and a tubular shell support frame mounted to the first and second leg units and arranged to lie under the seat shell.
Figure 5:
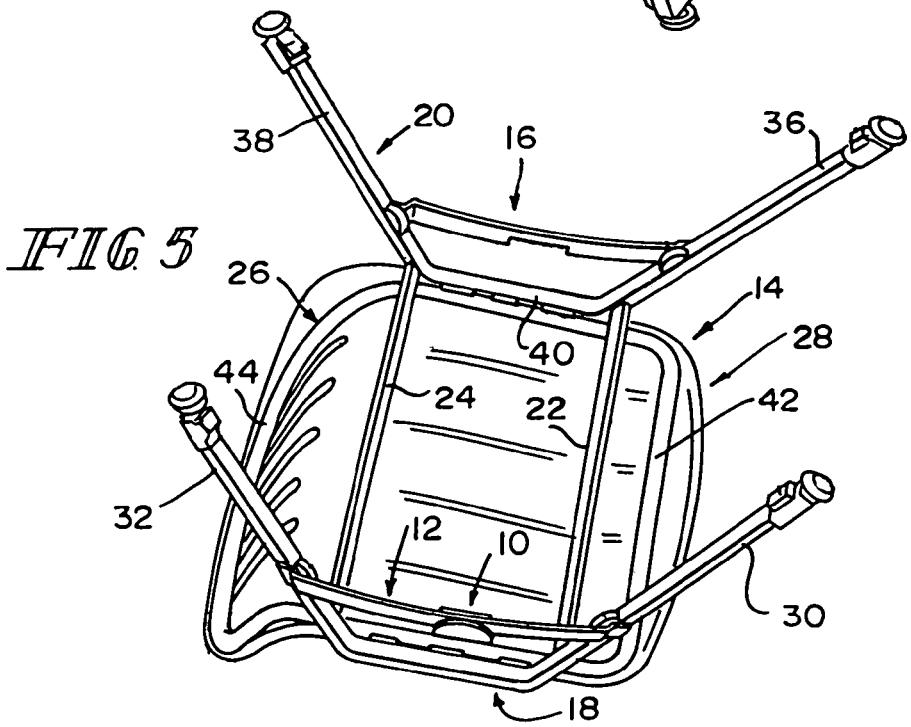
FIG. 5 is a view of the chair shown in FIGS. 1 and 4 after the chair has been inverted to show the underside of the seat shell and showing the gang flange on the first cross bar and the gang-flange receiver channel formed in the second cross bar.

Chair 14 includes a first leg unit 18 carrying first cross bar 12, a second leg unit 20 carrying second cross bar 16, and front and rear frame members 22, 24 as shown, for example, in FIGS. 1, 4, and 5. A shell-support frame 26 is coupled to each of first and second leg units 18, 20 and configured to support seat shell 28 as shown, for example, in FIGS. 1, 4, and 5. First leg unit 18 includes front leg 30, rear leg 32, and first leg connector 34 arranged to interconnect front and rear legs 30, 32. Second leg unit 20 includes front leg 36, rear leg 38, and second leg connector 40 arranged to interconnect front and rear legs 36, 38.

Shell-support frame 26 includes a lower U-shaped portion 42 coupled to first and second leg units 18, 20 using any suitable means. Frame 26 also includes an upper U-shaped portion 44 coupled to lower U-shaped portion 42 as suggested in FIGS. 4 and 5. In the illustrated embodiment, an endless tubular member is used to define shell-support frame 26. Seat shell 28 is coupled to shell-support frame 26 using any suitable means.

As suggested in FIGS. 7 and 9*a*, gang flange 10 includes a first side wall 46, a second side wall 48, and a top wall 50 arranged to interconnect first and second side walls 46, 48. Second side wall 48 is arranged to lie in spaced-apart relation to first side wall 46 to define a cross bar retainer channel 52 therebetween. As shown best in FIGS. 8 and 9*a*, portions of first cross bar 12 of first chair 14 and of second cross bar 16 of second chair 16 extend into cross bar retainer channel 52 formed in gang flange 10 to gang chairs 14, 14' to one another in the manner shown in FIG. 2.

In the illustrated embodiment, first side wall 46 of gang flange 10 has a rectangular shape and a straight lower edge 47. The length 41 of lower edge 47 is longer than the width 43 of vertical edge 45 as suggested in FIG. 8. Second side wall 48 includes an upper portion 53 coupled to top wall 50 and a lower portion 54 having a convex curved lower edge 49. In the illustrated embodiment, lower edge 47 is located a first distance 56 from top wall 50 and the lowest portion of lower edge 49 is located a second distance 58 from top wall 50 and first distance 56 is greater than second distance 58 as shown, for example, in FIG. 9*a*.

First cross bar 12 includes a front leg mount 60 coupled to front leg 30, a rear leg mount 62 coupled to rear leg 32, and a "fixed" plate 64 arranged to interconnect front and rear leg mounts 60, 62 as suggested in FIGS. 6 and 7. Front leg mount 60 includes a top edge 66 and an end edge 67 and rear leg mount 62 includes a top edge 68 and an end edge 69 as shown in FIG. 7. Fixed plate 64 includes a top edge 70 that cooperates with end edges 67, 69 to define a gang-flange receiver channel 71 sized to receive top wall 50 of gang flange 10 therein when gang flange 10 is coupled (e.g., welded) to fixed plate 64 of first cross bar 12 as suggested in FIGS. 8 and 9*a*. In the illustrated embodiment, first cross bar 12 is formed to include laterally extending stiffening ribs 72.

Second cross bar 16 has the same configuration as first cross bar 12. Second cross bar 16 includes a front leg mount 74 coupled to front leg 36, a rear leg mount 76 coupled to rear leg 38, and a "removable" plate 78 arranged to interconnect front and rear leg mounts 74, 76 as suggested in FIGS. 6 and 7. Although removable plate 78 does not move relative to front and rear leg mounts 74, 76, it does move in and out of cross bar retainer channel 52 formed in gang flange 10 during mating and unmating of gang flange 10 on second cross bar 16. In contrast, fixed plate 64 is coupled to first side wall 46 of gang flange 10 to anchor gang flange 10 in a fixed position on first cross bar 12. In the illustrated embodiment, fixed plate 64 is located in cross bar retainer channel 52 as shown in FIG. 9*a*.

Front leg mount 74 of second cross bar 16 includes a top edge 80 and an end edge 81 and rear leg mount 76 includes a top edge 82 and an end edge 83 as suggested in FIGS. 6, 8, and 9*a*. Removable plate 78 includes a top edge 84 that cooperates with end edges 81, 83 to define a gang-flange receiver channel 85 sized to receive top wall 50 of gang flange 10 therein when gang flange 10 is mated with second cross bar 16 as suggested in FIGS. 8 and 9*a*.

In the embodiment illustrated in FIGS. 7, 8, and 9*a*, exterior surface 86 of top wall 50 of gang flange 10 is arranged to lie in coplanar relation to top edges 66, 68 on first cross bar 12 and to top edges 80, 82 on second cross bar 16 when gang flange 10 is mated to both cross bars 12, 16. In the embodiment shown in FIG. 9*b*, exterior surface 86 of top wall 50 of gang flange 10 lies a distance 88 below a plane 89 established by top edges 66, 68 of first cross bar 12 and by top edges 80, 82 of second cross bar 16. Top wall 50 of gang flange 10 also includes an interior surface 87 that is located in cross bar retainer channel 52 and is arranged to engage top edge 84 of removable plate 78 and lie a distance 90 below plane 89 as suggested in FIG. 9*b*. In the embodiments shown in FIGS. 9*a* and 9*b*, gang flange 10 does not protrude above top surfaces on first and second cross bars 12, 16 and presents a recessed and compact appearance.

Figure 2:
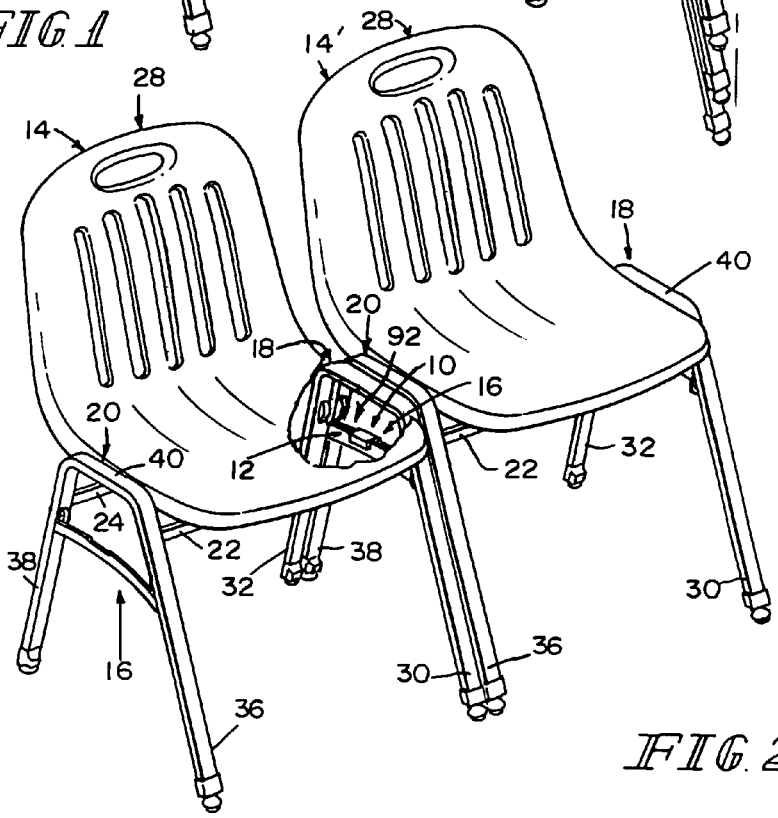
FIG. 2 is a perspective view similar to FIG. 1 showing two chairs of the type shown in FIG. 1 wherein the gang flange on the left chair is mated with the gang-flange receiver channel on the right chair to link the two chairs together in side-by-side "ganged" relation.

A flange mount 92 is adapted to be coupled to two chairs 14, 14' arranged to lie adjacent to one another in side-by-side relation as suggested in FIG. 2. Flange mount 92 is arranged to extend into the cross bar retainer channel 52 formed in gang flange 10. Flange mount 92 includes a fixed plate 64 coupled to first side wall 46 of gang flange 10 and arranged to lie in the cross bar retainer channel 52 and removable plate 78 arranged to lie in cross bar retainer channel 52 in a space provided between second side wall 48 of gang flange 10 and fixed plate 64. Each of fixed and removable plates 64, 78 is flat and fixed plate 64 is arranged to lie in abutting side-by-side relation to removable plate 78 as shown, for example, in FIG. 9*a*. Fixed plate 64 is arranged to lie in abutting side-by-side relation to each of first side wall 46 and removable plate 78 and removable plate 78 is arranged to lie in abutting side-by-side relation to second side wall 48.

First cross bar 12 includes a top edge 66, 68 interrupted by the gang-flange receiver channel 71 formed in the first cross bar 12. Second cross bar 16 includes a top edge 80, 82 interrupted by the gang-flange receiver channel 52 formed in the second cross bar 16.

What is claimed is:

1. A chair ganger apparatus comprising a gang flange including a first side wall, a second side wall, and a top wall arranged to interconnect the first and second side walls and support the second side wall in spaced-apart relation to the first side wall to define a cross bar retainer channel therebetween and a flange mount adapted to be coupled to two chairs arranged to lie adjacent to one another in side-by-side relation, wherein the flange mount includes a fixed plate coupled to the first side wall of the gang flange and arranged to extend into the cross bar retainer channel and a removable plate arranged to extend into the cross bar retainer channel in a space provided between the second side wall of the gang flange and the fixed plate, the flange mount also includes a first cross bar formed to include the fixed plate and adapted to be coupled to two legs of a first chair and a second cross bar formed to include the removable plate and adapted to be coupled to two legs of a second chair, each of the first and second cross bars is formed to include a gang-flange receiver channel, and the top wall of the gang flange is positioned to lie in the gang-flange receiver channel formed in each of the first and second cross bars.

2. The chair ganger apparatus of claim 1, wherein the first cross bar includes a top edge interrupted by the gang-flange receiver channel formed in the first cross bar, the top wall of the gang flange includes an exterior surface located outside of the cross bar retainer channel, and the top edge of the first cross bar and the exterior surface of the top wall of the gang flange are arranged to lie in coplanar relation to one another.

3. The chair ganger apparatus of claim 2, wherein the second cross bar includes a top edge interrupted by the gang-flange receiver channel formed in the second cross bar and the top edge of the second cross bar is arranged to lie in coplanar relation to the top edge of the first cross bar and the exterior surface of the top wall of the gang flange.

4. The chair ganger apparatus of claim 1, further comprising a first chair including a front leg and a rear leg, and wherein the first cross bar further includes a front leg mount coupled at one end to the fixed plate and at an opposite end to the front leg of the first chair and a rear leg mount coupled at one end to the fixed plate and at an opposite end to the rear leg of the first chair and wherein the fixed plate is located between the front and rear leg mounts.

5. The chair ganger apparatus of claim 4, wherein the front leg mount includes a top edge and a first end edge, the rear leg mount includes a top edge and a second end edge, the fixed plate includes a top edge, and the first end edge of the front leg mount, the second end edge of the rear leg mount, and the top edge of the fixed plate cooperate to define a boundary of the gang-flange receiver channel.

6. The chair ganger apparatus of claim 5, wherein the top wall of the gang flange includes an interior surface located inside the cross bar retainer channel and arranged to engage the top edge of the fixed plate.

7. The chair ganger apparatus of claim 5, wherein the top wall of the gang flange includes an exterior surface located outside of the cross bar retainer channel and arranged to lie in at least one of coplanar relation to and below the top edges of the front and rear leg mounts.

8. The chair ganger apparatus of claim 4, further comprising a second chair including a front leg and a rear leg and wherein the second cross bar further includes a front leg mount coupled at one end to the removable plate and at an opposite end to the front leg of the second chair and a rear leg mount coupled at one end to the removable plate and at an opposite end to the rear leg of the second chair and wherein the removable plate is located between the front and rear leg mounts of the second cross bar.

9. The chair ganger apparatus of claim 8, wherein the front leg mount of the second cross bar includes a top edge and a first end edge, the rear leg mount of the second cross bar includes a top edge and a second end edge, and the removable plate includes a top edge, and the first end edge of the second cross bar, the second end edge of the second cross bar, and the top edge of the removable plate cooperate to define a boundary of the gang-flange receiver channel formed in the second cross bar.

10. The chair ganger apparatus of claim 9, wherein the top wall of the gang flange includes an exterior surface located outside of the cross bar retainer channel and arranged to lie in at least one of coplanar relation to and below the top edges of the front and rear leg mounts of the second cross bar.

11. The chair ganger apparatus of claim 1, further comprising a chair including a front leg and a rear leg and wherein the second cross bar further includes a front leg mount coupled at one end to the removable plate and at an opposite end to the front leg of the chair and a rear leg mount coupled at one end to the removable plate and at an opposite end to the rear leg of the chair and wherein the removable plate is located between the front and rear leg mounts of the second cross bar.

12. The chair ganger apparatus of claim 11, wherein the front leg mount includes a top edge and a first end edge, the rear leg mount includes a top edge and a second end edge, the fixed plate includes a top edge, and the first end edge of the front leg mount, the second end edge of the rear leg mount, and the top edge of the fixed plate cooperate to define a boundary of the gang-flange receiver channel.

13. The chair ganger apparatus of claim 11, wherein the top wall of the gang flange includes an interior surface located inside the cross bar retainer channel and arranged to engage the top edge of the fixed plate.

14. A chair ganger apparatus comprising a first chair including a first cross bar including a top edge interrupted by a gang flange receiver channel formed in the first cross bar, a second chair including a second cross bar arranged to abut the first cross bar and a gang flange having a U-shaped cross section and including a first side wall abutting the first cross bar, a second side wall abutting the second cross bar to retain the first and second cross bars in a space formed between the first and second side walls, and a top wall arranged to interconnect the first and second side walls and extend into the gang flange receiver channel formed in the first cross bar.

15. The chair ganger apparatus of claim 14, wherein the first chair further includes a front leg and a rear leg and the first cross bar is coupled to each of the front and rear legs of the first chair and the second chair further includes a front leg and a rear leg and the second cross bar is coupled to each of the front and rear legs of the second chair.

16. The chair ganger apparatus of claim 14, wherein the second side wall includes a convex curved lower edge arranged to lie in spaced-apart relation from the top wall.

17. The chair ganger apparatus of claim 14, wherein each of the side walls comprises a flat plate.

* * * * *